US008776346B2

(12) United States Patent
Lipscomb

(10) Patent No.: US 8,776,346 B2
(45) Date of Patent: Jul. 15, 2014

(54) PRODUCTION AND APPLICATION OF BIODEGRADABLE SEDIMENT CONTROL DEVICE

(75) Inventor: Chad M. Lipscomb, Woodland, CA (US)

(73) Assignee: Western Excelsior Corp., Evansville, IN (US)

( * ) Notice: Subject to any disclaimer, the term of this patent is extended or adjusted under 35 U.S.C. 154(b) by 0 days.

(21) Appl. No.: 13/573,373

(22) Filed: Sep. 12, 2012

(65) Prior Publication Data

US 2013/0149048 A1 Jun. 13, 2013

(51) Int. Cl.
*B32B 38/00* (2006.01)

(52) U.S. Cl.
USPC ..... 29/430; 256/12.5; 156/227

(58) Field of Classification Search
USPC ..... 405/302.6, 302.7, 15–17, 32, 302.4; 256/12.5; 29/430; 156/91, 201, 204, 156/227
See application file for complete search history.

(56) References Cited

U.S. PATENT DOCUMENTS 3,557,156 A * 1/1971 Enneper et al. ..... 156/383

* cited by examiner

*Primary Examiner* — Sunil Singh
(74) *Attorney, Agent, or Firm* — Don Halgren

(57) ABSTRACT

An elongated web of flexible material having a covering of excelsior across a portion thereof has an elongated edge portion uncovered. The elongated covered portion is folded over upon itself a number of times, and the elongated uncovered side portion (a tail) are wound upon a roll for utilization after unrolling, as a sediment barrier, properly staked into the ground.

7 Claims, 5 Drawing Sheets

PRODUCTION AND APPLICATION OF BIODEGRADABLE SEDIMENT CONTROL DEVICE

BACKGROUND OF THE INVENTION

1. Field of the Invention

This invention relates to sediment control and bio-degradable perimeter guards to minimize the sediment leakage from a dangerous or polluted ground site or for filtration of a sediment-laden water flow, and is based upon Provisional patent application Ser. No. 60/936,603, filed 21 Jun. 2007, and is incorporated herein by reference in its entirety.

2. Prior Art

Erosion has an enormous impact on our environment, our water sources and supply and agriculture resources and upon wildlife. Such effects have cost billions of dollars each year trying to manage or correct for those effects. Channels and waterways become filed with sediment, shorelines may be lost, and fertilizers may collect in water supplies to poison such water. Much of this may be irreversible.

Methods of trying to control such flow of sediment have included flexible hose-like logs filled with sand or other heavy material, plastic type silt fences around stockpiles of sand/fertilizers/salt etc, to minimize erosion therefrom, and inlet filters which are weighted filament members which may surround a water outlet or the like.

Some of these devices do not adequately control or trap the flow of sediment or provide adequate means for its collection or prevention. Current state of the art methods and products also severely restrict fluid flow, present safety concerns and require subsequent removal from the site upon completion of construction activities.

It is therefore an object of the present invention to overcome the disadvantages of the prior art.

It is a further object of the present invention to provide a silt wall sediment control arrangement which is readily deployable and very effective.

It is still yet a further object of the present invention to provide a sediment control wall which is easy to install and in which the costs to manufacture and control sediment flow are kept to a minimum.

BRIEF SUMMARY OF THE INVENTION

The construction arrangement of the present invention which is a biodegradable sediment control device comprises a series of adjacent, material-process-assembly stations leading to the final product to be packaged and delivered to the ultimate user. The assembly process begins with a roll of flexible mesh or geo-textile material having a width of about for example, several feet wide. That roll of material, as it is unwound, is pulled over a first horizontal platform. That first horizontal platform has a fiber reservoir/matrix feeder distributor suspended thereover.

The fiber reservoir/matrix feeder distributes a spray of fiber which typically comprises excelsior wood fiber or coconut, straw, synthetics or a blend thereof across most of the mesh and geo-textile material being passed thereunder, except for a "tail" portion, described hereinbelow. A further operation may take place on that first platform which may include a fiber-spreading brush arrangement utilized to evenly spread out any fibrous material distributed across the web traveling thereunder.

The "downstream" movement of the web of mesh and geo-textile material, is now coated with a generally even layer of fibrous excelsior, except for a one elongated side portion thereof, which is characterized as the "tail", which will remain uncovered during this process.

The web of material both the covered portion and the uncovered (tail or side) portion is driven into a second operating station. The second operating station is comprised of a first folding roller section which takes the "covered" portion of the traveling web and folds it "once-over" upon itself as it moves downstream leaving the tail or uncovered portion untouched and uncovered traveling along with that now once-folded portion. Preferably, the folded web of material and the tail, at the second station, are moved to a second series of rollers which again folds the previously folded portion a second time, without effecting the tail or uncovered portion of the web of material. A further preferred embodiment may be comprised of web materials with only a single overlapping fold.

The web of material, including the uncovered tail portion may be driven or drawn down to a continuing series of folding rollers, for folding again, for a number of compounding folds such that the final product is folded for example, one to ten times with the current number of folded portion passing down from the previous set of rollers. Throughout the folding process, the tail portion still remains unaffected, moving downstream along with the thrice folded section.

The folded web of material and its associated uncovered tail portion now pass through a fourth set of rollers which flips the entire traveling web over 180 degrees about its longitudinal axis.

The uncovered tail section is now hanging from the opposite side of the horizontally disposed folded member as it travels downstream to a third processing station which applies an elongated roll of pocket netting onto the now upwardly facing side of the folded web. That elongated roll of pocket netting goes to a yet further station which includes a sewing head which stitches or otherwise adheres the pocket netting to the web material. Alternatively, fastener hardware or a stake may be directly secured to the folded member.

A final rolling station flips the exposed uncovered tail portion inwardly and all is wound on a receiving roll with the tail portion radially inwardly of its adjacent fiber filled web portion.

In the present web matrix, the pocket netting or securing hardware is utilized to receive a stake, which pockets/hardware are spaced longitudinally apart on the matrix of web material. The uncovered tail is lain on the ground, the tail and filled matrix portion being of generally "L" shape in cross-section. The tail portion is secured to the ground by landscape staples, in rough lateral proximity to the stakes which are received in the pockets of the fabric stitched against the folded excelsior matrix.

The invention thus comprises a system for the assembly of an elongated biodegradable sediment control device comprising: a series of operating stations arranged to receive an elongated web of flexible material from a source roll, the series including a first station for depositing a supply of excelsior treatment material on the elongated web, a second station for folding the web onto itself; and a third station for attaching an elongated web with pockets thereon from a web and pocket supply roll. The second station may comprise a plurality of web folding guides for repeatedly folding the web onto itself. The first station supply of excelsior or other fiber/filler material is preferably applied to the web across only a portion of the width of the web moving therebeneath. The first station may includes a treatment material spreader member to ensure proper distribution of treatment material on the moving web. The web preferably has an elongated side or "tail" portion which is treatment free. The tail portion preferably extends the full length of the elongated biodegradable sediment control device. The second station preferably comprises a series of folding guides for folding the web onto itself for example, three times, during its travel of its assembly. The assembly preferably includes a fourth station having a set of guides for flipping the traveling web over in a 180 degree flip around its longitudinal axis to permit the tail to be subsequently folded under the elongated biodegradable sediment control device.

The invention also comprises an elongated biodegradable sediment control device comprised of an elongated excelsior or other fiber/filler material treatment-material coated portion and an elongated treatment-material free portion, wherein the elongated treatment-material coated portion of the elongated web is folded onto itself, for example, from one to ten times. The elongated treatment-material coated portion preferably has a second flexible web attached to a radially outer portion thereof. The second flexible web attached to the radially outer portion thereof preferably has a plurality of longitudinally spaced-apart pockets thereon. The spaced-apart pockets are arranged to receive ground web-supporting stakes therein. The second flexible web is preferably stitched to only the elongated treatment-material portion of the elongated biodegradable sediment control device. The second flexible web may be adhesively attached to the elongate treatment material portion of the elongated biodegradable sediment control device.

The invention also comprises an elongated biodegradable sediment control device comprised of an elongated excelsior or other fiber or filler treatment-material coated portion and an elongated treatment-material free portion, wherein the elongated treatment-material coated portion of the elongated web is folded onto itself one to ten times, wherein treatment portion and the treatment-free portion are of "L" shape when applied to a ground location and the treatment portion of the web has an arrangement of stake receiving pockets/hardware thereattached for receipt of ground engaging stakes therein.

BRIEF DESCRIPTION OF THE DRAWINGS

The objects and advantages of the present invention will become more apparent when viewed in conjunction with the following drawings in which.

DETAILER DESCRIPTION OF THE INVENTION

Figure 1:
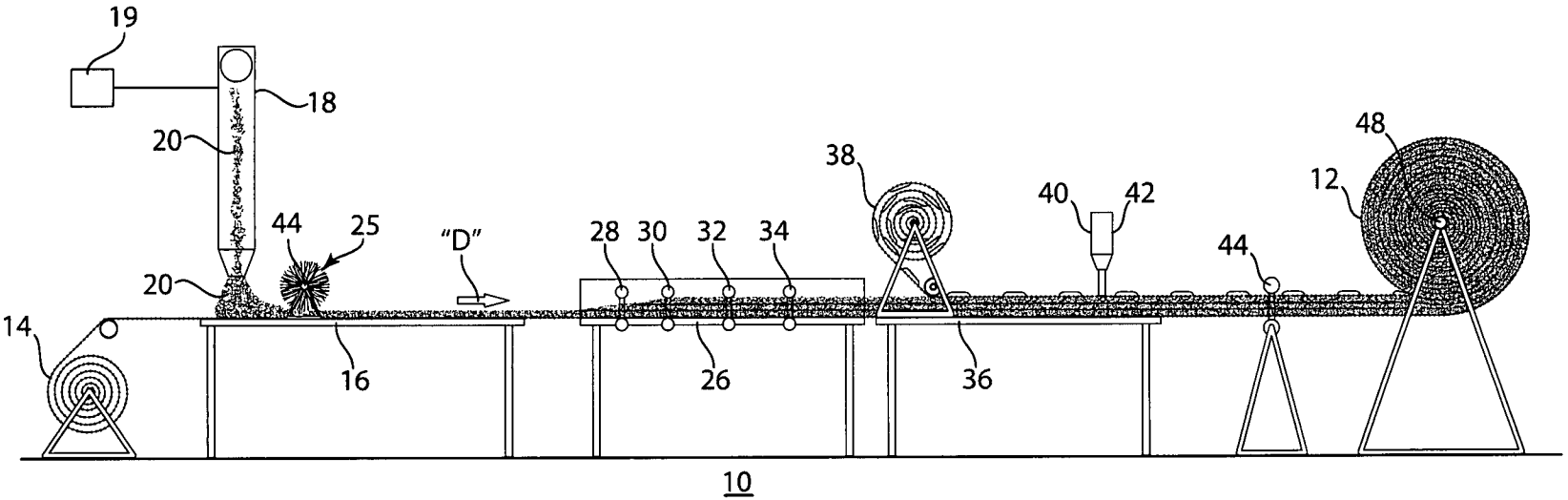
FIG. 1 is a schematic representation of the assembly process showing the stations and methodology in the manufacture of the present invention.

Referring to the drawings in detail, and particularly to FIG. 1, there is shown the present invention which comprises an assembly process comprising a series of process stations 10 leading to production of the final biodegradable sediment control device matrix product 12 to be packaged and delivered to the ultimate user.

The assembly process begins with a roll of biodegradable, flexible mesh or geo-textile material 14 having a width of about, for example, 2 to about 3 feet wide. That roll of material 14, as it is unwound, is drawn or pulled over a first horizontal platform 16. That first horizontal platform 16 has a transversely depositing fiber reservoir/matrix feeder distributor 18 suspended thereover. The fiber reservoir/matrix feeder 18 gravitationally or pressurizably controlled distribution, by a controlled pressurized system 19 of a transversely extending layer of fiber/excelsior 20 across at least most of the mesh and geo-textile material 14 being passed thereunder, except for an elongated, fiber/excelsior-free "tail" portion 22, shown in FIG. 2A et seq., and described hereinbelow.

A further operation preferably takes place on that first (or subsequent) platform 16 which includes a cylindrically shaped fiber-spreading brush arrangement 24, rotatable about its longitudinal axis 25, and utilized to evenly spread out any irregularly-disposed fibrous material 20 distributed across the web 14 traveling thereunder.

The "downstream" movement of the web 14 of mesh and geo-textile material, indicated by the arrow "D", is now coated with a generally even layer of fiber matrix 20, except for a one elongated side-portion thereof, which is characterized as the "tail" 22, which will remain uncovered by fiber 20 during this process, and is shown in sequence in FIGS. 2A, 2B, 2C, 2D, 2E and 2F.

Figure 2A:
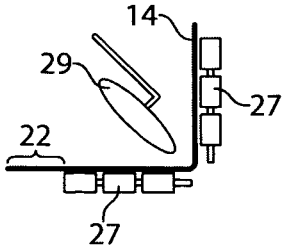
FIGS. 2A, B, C, D, E and F are cross-sectional views representing the rollers folding the matrix portion of the web as it travels downstream.
Figure 2B:
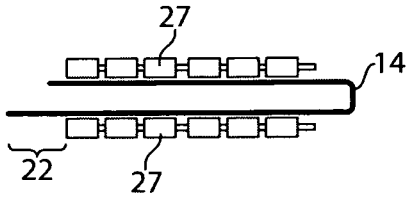
Figure 2C:
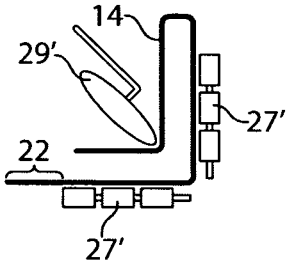
Figure 2D:
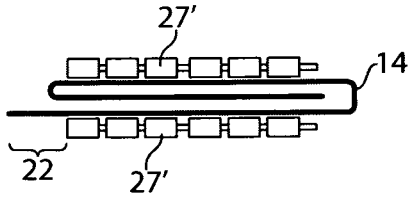
Figure 2E:
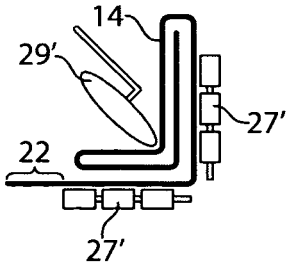
Figure 2F:
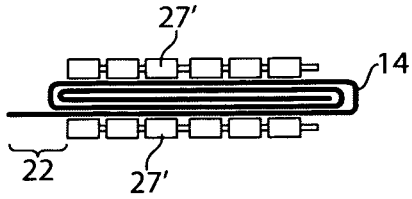

The web of material 14, now also both the covered portion 20 and the uncovered (tail or side) portion 22 is driven into a second operating station 26. The second operating station 26, represented in FIGS. 1 and 2A, 2B and 2C, is comprised of a first folding roller section 28 which takes the fiber "covered" portion of the traveling web and folds it "once-over" upon itself as it moves downstream, as shown in FIGS. 2A and 2B, leaving the tail or uncovered portion 22 untouched and uncovered traveling along with that now once-folded portion. The first "roller" section 28 comprises a set of oblique to non-oblique guides 27 and a web creaser-roll 29 which forms the moving web 14 into an initial "L" shape in cross-section in FIG. 2A, then completes the transition to a first fold-over of the web 14, as represented in cross-section in FIG. 2B.

The folded web of material 14 including the tail 22, at the second station 26 are moved to a second series of "guide rollers" 30, shown in FIGS. 2C and 2D, which again moves through oblique to non-oblique guides 27' and creaser-roll 29' to fold the previously folded portion 14 a second time, without effecting the tail or uncovered portion 22 of the web of material, as shown in FIGS. 2C and 2D.

The web of material 14, including the uncovered tail portion 22 is driven down to a third set of folding "guide rollers" 32, shown in FIGS. 2E and 2F, folding again, for a third time that previously folded web portion passing down through oblique to non-oblique guides 27" and creaser 29" comprising the third set of guide rollers 32. The tail portion 22 still remaining unaffected and moves downstream with the thrice folded section.

Figure 3A:
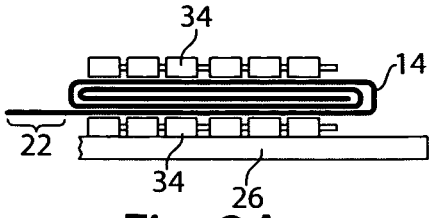
FIGS. 3A, B and C are plan views representing a roller arrangement flipping the web over 180 degrees about its longitudinal axis as it moves downstream.
Figure 3B:
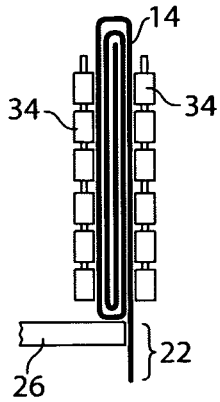
Figure 3C:
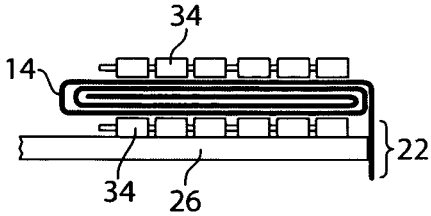

The thrice folded web of material 14 and its associated uncovered tail portion 22 now pass through a fourth set of guides or rollers 34 which flips the entire traveling web over 180 degrees about its longitudinal axis, as represented in FIGS. 3A, 3B and 3C.

Figure 4:
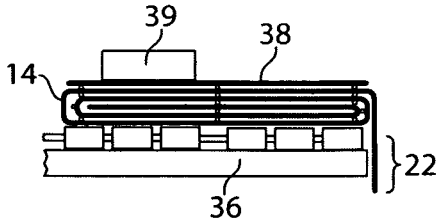
FIG. 4 is a cross sectional representation of the web matrix as its pocket fabric is attached.

The uncovered tail section 22 is now hanging from the opposite side of the horizontally disposed folded member 14 as it travels downstream to a third processing station 36 which applies an elongated roll of netting 38 having a plurality of spaced apart pockets 39 onto the now upwardly facing side 40 of the multiply folded web 14. That elongated roll of pocket netting 38 goes to a yet further station 40 which includes an adhesive nozzle arrangement or sewing head 42 which glues or stitches the elongated pocket netting 38 and hence the pockets 39, to the elongated web material 14, as represented in FIG. 4.

Figure 5:
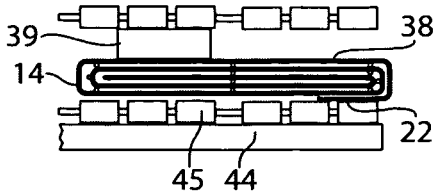
FIG. 5 is a cross sectional representation of the web matrix as its tail portion is folded under the matrix portion of the web.

A final rolling station 44 shown in FIGS. 1 and 5, has a guide 45 which channels and guides and flips the exposed uncovered tail portion 22 inwardly and all is wound on a receiving roll 48, shown in FIG. 1, with the tail portion 22 moving radially inwardly of its adjacent fiber filled web portion 14, as represented in cross-section in FIG. 5.

Figure 6:
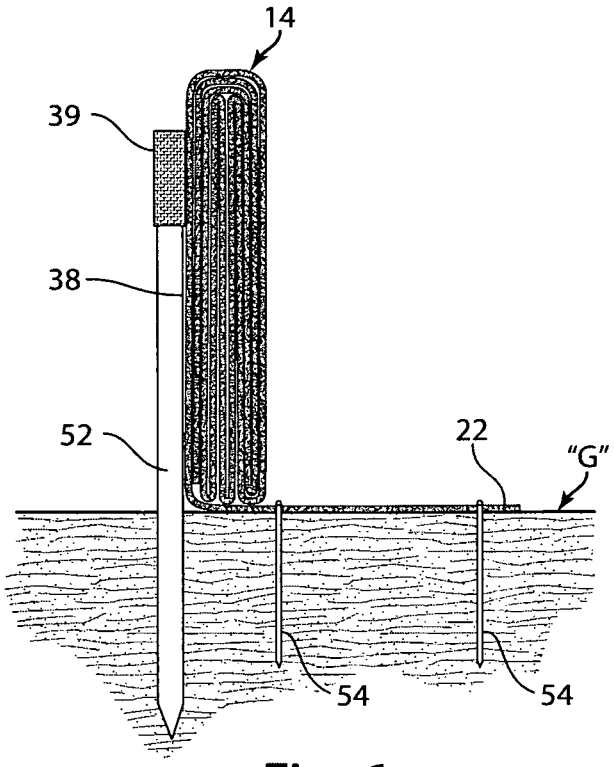
FIG. 6 is an edge view of the web matrix and tail portion properly secured to a ground surface.
Figure 7:
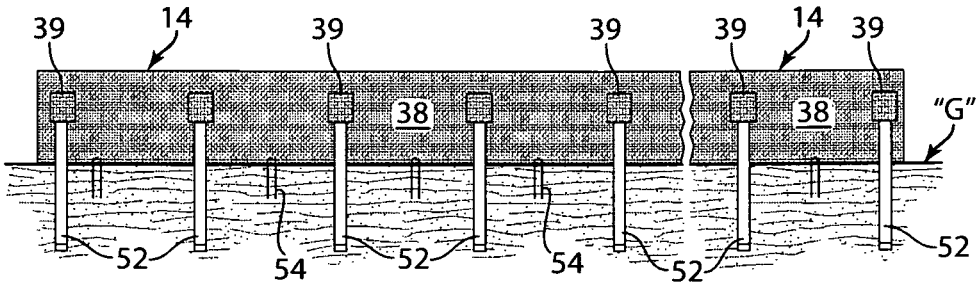
FIG. 7 is an elevational view taken along the lines 7-7 in FIG. 6.
Figure 8:
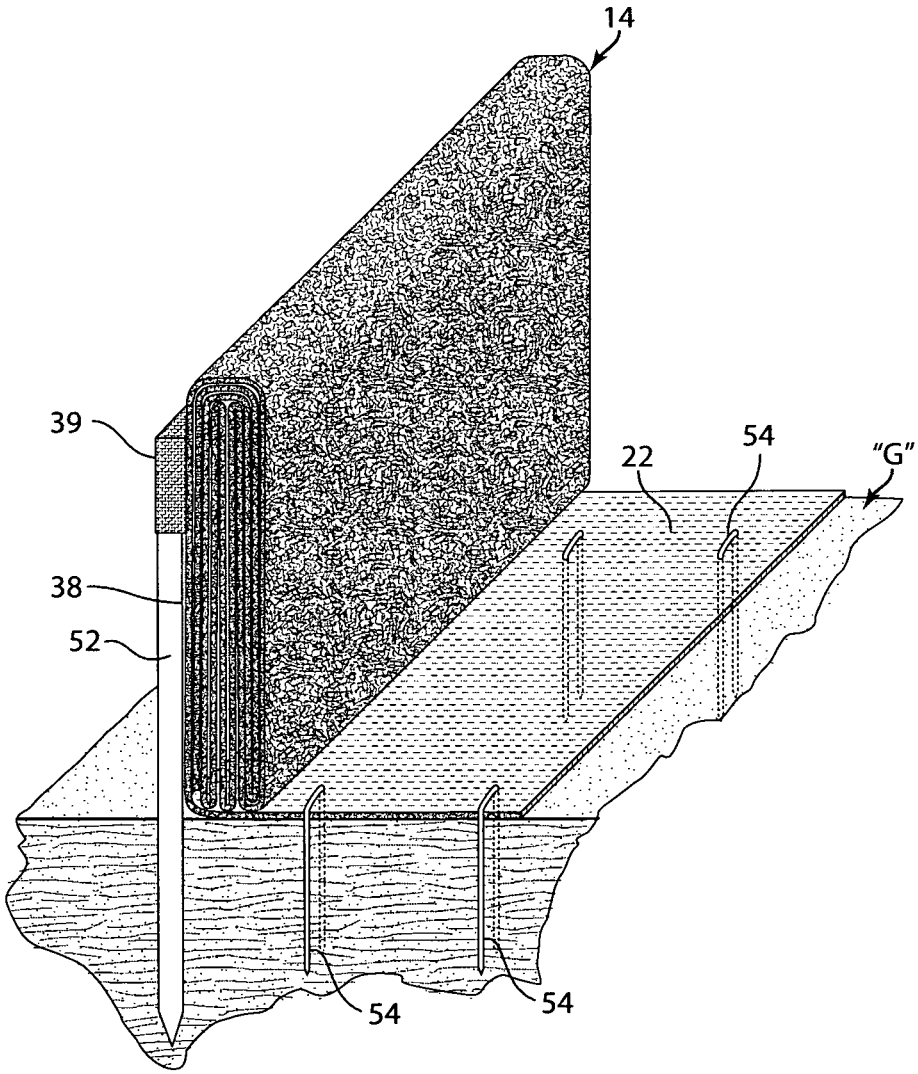
FIG. 8 is a perspective view of the web matrix represented in FIG. 6.

In utilization of the present product, the pocket 39 on the netting 38 attached to the elongated treated web 14 is utilized to receive a stake 52, which pockets 39 are spaced longitudinally apart on the matrix of the attached web material 38. The uncovered tail 22 is lain on the ground "G", the tail 22 and filled matrix portion being of generally "L" shape in cross-section, as is shown in FIGS. 6 and 8. The tail portion 22 is secured to the ground "G" by landscape staples 54, in rough lateral proximity to the stakes 52 which are received in the pockets of the fabric stitched against the folded excelsior matrix represented in FIGS. 6, 7 and 8.

I claim:

1. A system for the assembly of an "L"-shapeable, temporary, elongated, inelastic, biodegradable sloped-soil-restricting sediment control device, comprising:

a series of operating stations arranged to receive an inelastic biodegradable elongated web of flexible backing material from a source roll, the series including a treatment-material-width-distributing-limited first station arranged to deposit a supply of excelsior treatment material on only one longitudinally extending side-portion of the inelastic, biodegradable elongated web of flexible backing material, a second station arranged for folding only the one longitudinally extending treatment-material-supplied side-portion of the inelastic biodegradable elongated web of flexible backing material over onto itself; and a third station arranged to attach a plurality of longitudinally spaced-apart transversely-oriented, wooden-stake-receiving-pockets on the biodegradable elongated web of flexible backing material from an overhead transversely-oriented, wooden-stake-receiving pocket-applying web and pocket supply roll to enable the supportive assembly of an "L" shaped, wooden-stake-supportable, sloped-soil-restricting sediment control device onto a sloped soil environment.

2. The system as recited in claim 1, wherein the second station comprises a plurality of web folding guides for repeatedly folding the web onto itself.

3. The system as recited in claim 2, wherein the second station comprises a set of three folding guides for folding the web onto itself three times during its travel of its assembly.

4. The system as recited in claim 1, herein the first station includes a width-distribution-limiter treatment material spreader member arrangement to enable one-side limited distribution of treatment material on the moving web.

5. The system as recited in claim 1 wherein the assembly includes a fourth station arranged to have a 180-degree-web-flipping set of guides thereon arranged to flip the traveling web over in a 180 degree flip around its longitudinal axis to permit a longitudinally extending tail portion thereon to be subsequently folded under the elongated biodegradable sediment control device.

6. A system for the assembly of an "L" shaped, temporary, elongated, inelastic biodegradable soiled-slope-restricting sediment control device, comprising:

a series of overhead operating stations arranged to receive a linear elongated web of inelastic, biodegradable, flexible material drawn from a source roll moving therebeneath, the series of operating stations including a one-side width-restricted-biodegradable-material-depositing first station for depositing a supply of biodegradable excelsior treatment material along only one elongated side of an elongated web, a web-treated-portion web-folding second station arranged to fold an elongated treated portion of the web only onto an elongated treated portion of itself; and a wooden-stake-receiving-webbed-pocket-array-depositing third station arranged for attaching an elongated web with pockets thereon only onto the elongated biodegradable material treated portion of the elongated web.

7. The system as recited in claim 6, wherein the second station comprises a plurality of web-treated-portion folding guides arranged for repeatedly folding the only upon a treated portion of the web onto itself.

* * * * *